US008219020B2

(12) United States Patent
Ito

(10) Patent No.: US 8,219,020 B2
(45) Date of Patent: Jul. 10, 2012

(54) IMAGE FORMING APPARATUS

(75) Inventor: Yoshiyuki Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1002 days.

(21) Appl. No.: 11/857,580

(22) Filed: Sep. 19, 2007

(65) Prior Publication Data

US 2008/0080915 A1 Apr. 3, 2008

(30) Foreign Application Priority Data

Sep. 29, 2006 (JP) ..... 2006-267440

(51) Int. Cl.
*G03G 15/00* (2006.01)

(52) U.S. Cl. ..... 399/405; 399/361; 399/381; 271/186; 271/207; 271/258.01; 271/258.02; 271/304; 271/902

(58) Field of Classification Search ..... 399/361, 399/381, 405; 271/186, 207, 304, 258.01, 271/258.02, 902
See application file for complete search history.

(56) References Cited

U.S. PATENT DOCUMENTS

| | | | | |
|---|---|---|---|---|
| 5,586,758 | A | 12/1996 | Kimura et al. | |
| 5,915,157 | A | 6/1999 | Takenaka et al. | |
| 7,079,806 | B2 * | 7/2006 | Baek et al. | 399/405 |
| 7,120,370 | B2 * | 10/2006 | Watabe | 399/67 |

FOREIGN PATENT DOCUMENTS

| | | | |
|---|---|---|---|
| JP | 62-130963 | | 6/1987 |
| JP | 03-089052 | | 11/1991 |
| JP | 05043114 | A | 2/1993 |
| JP | 6087553 | A | 3/1994 |
| JP | 07242363 | A | 9/1995 |
| JP | 10265099 | A | 10/1998 |
| JP | 11024335 | A | 1/1999 |
| JP | 11139659 | A | 5/1999 |
| JP | 2002182441 | A | 6/2002 |
| JP | 2003-104616 | | 4/2003 |

OTHER PUBLICATIONS

Translation of JP 11139659 A, Suzuki et al., May 1999, Japan.*
Notice of Reasons for Rejection received for Japanese Patent Application No. 2006-267440, Mailing Date: Jul. 17, 2008.

* cited by examiner

*Primary Examiner* — Judy Nguyen
*Assistant Examiner* — Andy Pham
(74) *Attorney, Agent, or Firm* — Banner & Witcoff, Ltd.

(57) ABSTRACT

An image forming apparatus having a sheet support is described. Using one or more configurations, the number of parts for the sheet support may be reduced.

12 Claims, 14 Drawing Sheets

IMAGE FORMING APPARATUS

CROSS REFERENCE TO RELATED APPLICATION

This application claims priority from Japanese Patent Application No. 2006-267440, filed on Sep. 29, 2006, the entire subject matter of which is incorporated herein by reference.

FIELD

Aspects of the invention relate to image forming apparatuses.

BACKGROUND

An image forming apparatus including a main mechanical part covered with a housing is known. The main mechanical part includes an ejection portion configured to eject a recording sheet that undergoes a printing process in an image forming portion. The image forming apparatus is provided with an upper sheet receiving portion disposed on an upper surface of the housing and a side sheet receiving portion disposed on a side of the housing, which are configured to receive a recording sheet ejected from the ejection portion. The image forming apparatus includes a guide portion disposed facing the ejection portion and configured to guide a recording sheet ejected from the ejection portion selectively to the upper or side sheet receiving portion when the guide portion slidingly contacts the recording sheet.

SUMMARY

Aspects of the invention provide an image forming apparatus in which the number of parts may be reduced.

BRIEF DESCRIPTION OF THE DRAWINGS

Illustrative aspects of the invention will be described in detail with reference to the following figures in which like elements are labeled with like numbers and in which.

DETAILED DESCRIPTION

A first illustrative embodiment of the invention will be described in detail with reference to FIGS. 1 to 8. The image forming apparatus according to illustrative aspects of the invention is applied to a laser printer in this embodiment.

For purposes herein, aspects of the invention are shown in relation to an image carrier and developer carrier. In various aspects, the image carrier may include a photosensitive drum, photosensitive belt, or the combination of one of a photosensitive drum or belt and an intermediate transfer drum or belt. Further, the developer carrier may include a developer roller or other systems for conveying developer to the image carrier.

It is noted that various connections are set forth between elements in the following description. It is noted that these connections in general and, unless specified otherwise, may be direct or indirect and that this specification is not intended to be limiting in this respect.

Figure 1:
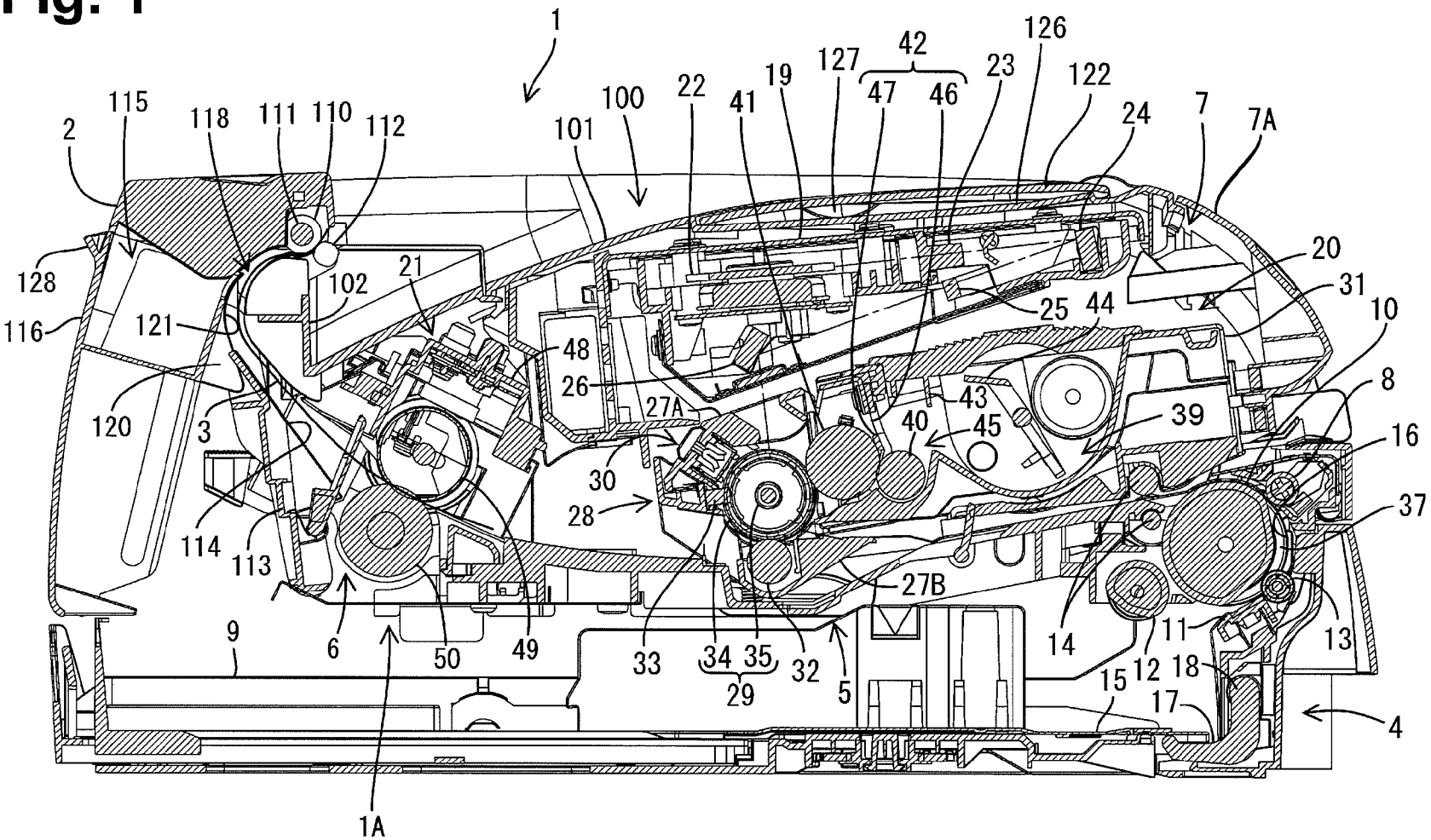
FIG. 1 is a side sectional view of a general structure of a laser printer as an image forming apparatus according to a first illustrative embodiment of the invention.

As shown in FIG. 1, a laser printer 1 is provided with a main mechanical part 1A inside a housing 2. The main mechanical part 1A includes a sheet supply mechanical part 4 for supplying a recording medium (hereinafter referred to as a recording sheet 3), an image forming part 5 for forming an image on the supplied recording sheet 3, and a sheet discharge mechanism 6 for discharging the recording sheet 3 on which the image has been formed. In the following description, the right side in FIG. 1 is regarded as a front of the laser printer 1, and the left side in FIG. 1 is regarded as a rear of the laser printer 1.

An upper surface of the housing 2 is downwardly recessed to provide an upper output tray 100 configured to receive a recording sheet 3 on which an image has been formed. The upper output tray 100 is provided with a receiving surface 101 inclining upwardly from rear to front of the laser printer 1. A rear end of the receiving surface 101 is provided with a receiving portion 102 standing vertically. When a recording sheet 3 is discharged to the upper output tray 100, the recording sheet 3 is placed on the receiving surface 101 and the trailing end of the recording sheet 3 is supported by the receiving portion 102.

A front sidewall (on the left side in FIG. 1) of the housing 2 is formed with an opening 7 and is provided with a front cover 7A configured to cover and uncover the opening 7. When the front cover 7A is opened, the opening 7 is released, and a process cartridge 20 is able to be attached to and removed from the main mechanical part 1A through the opening 7.

Figure 2:
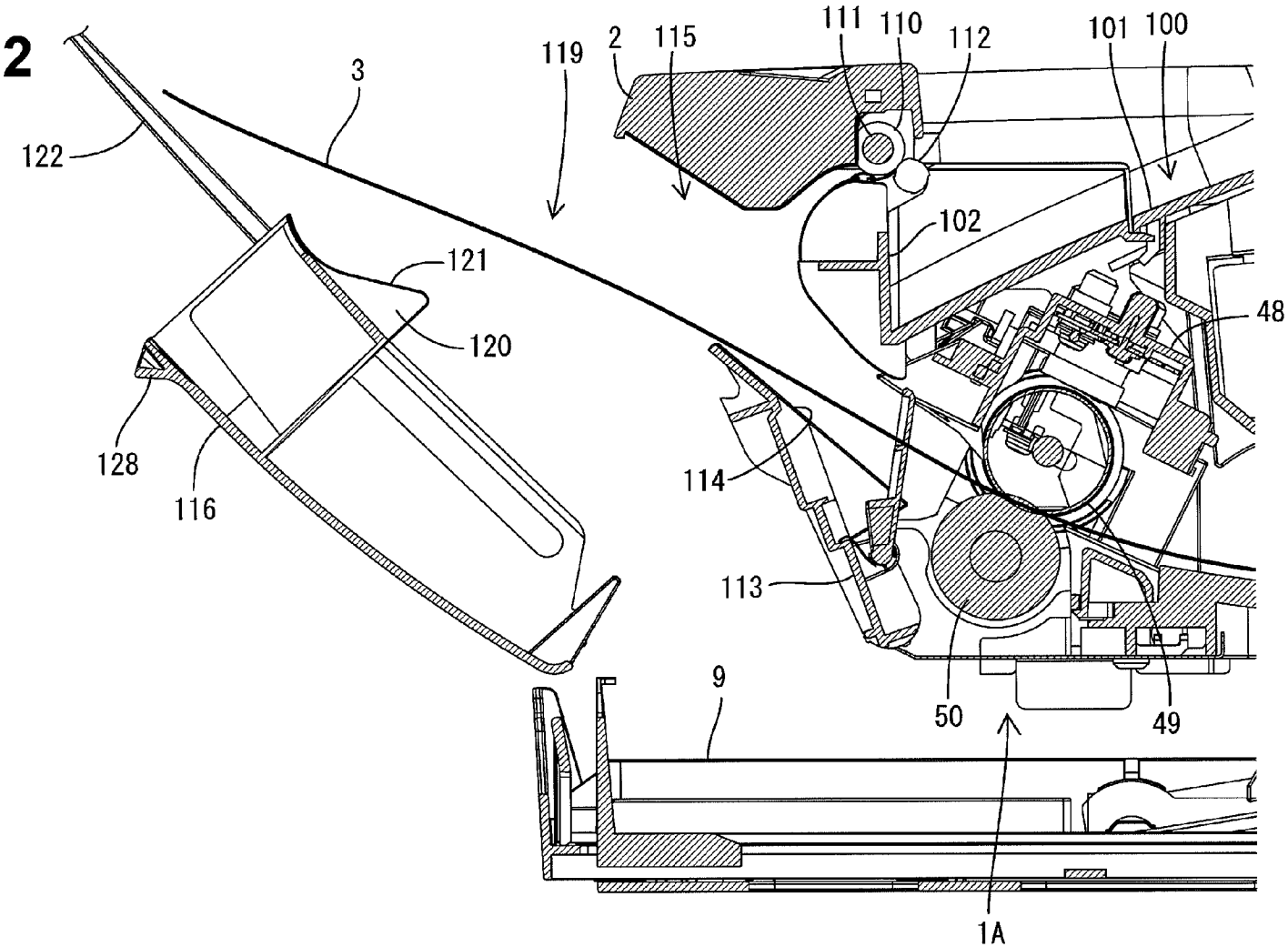
FIG. 2 is an enlarged side sectional view of the laser printer in which a rear cover is open according to illustrative aspects of the invention.

A rear sidewall (on the left side in FIG. 1) of the housing 2 is formed with an opening 115, and is provided with a rear cover 116 configured to cover and uncover the opening 115. As shown in FIG. 2, the rear cover 116 is mounted to the rear sidewall of the housing 2 so as to pivot on an axis extending horizontally (in a direction passing through the sheet of FIG. 2) in a lower portion of the opening 115. The rear cover 116 is pivotal between a closed position to cover the opening 115 shown in FIG. 1 and an open position to uncover the opening 115 shown in FIG. 2. An inner surface of the rear cover 116 is provided with lock portions 117 (FIG. 7) that protrude inwardly in a state where the rear cover 116 is in the closed position. The lock portions 117 are configured to engage a receiving portion (not shown) provided in the housing 2, so that the rear cover 116 is maintained in the closed position against the housing 2. When the rear cover 116 is in the open position, the inner surface of the rear cover 116 is designed so as to receive a recording sheet 3 that undergoes printing process. As shown in FIGS. 1 and 8, an outer surface of the rear cover 116 is provided with a finger hook portion 128 for receiving a finger of a user. The finger hook portion 128 protrudes outward at an upper end of the rear cover 116.

A sheet supply tray 9 is disposed in the lowermost part of the housing 2, and is configured to hold a stack of recording sheets 3 on which images are to be formed. The sheet supply tray 9 can be pulled out toward the front.

The sheet supply tray 9 may be in the shape of a box with an open top. A sheet pressing plate 15 is disposed in a lower portion of the sheet supply tray 9. A stack of recording sheets can be placed on an upper surface of the sheet pressing plate 15. The sheet pressing plate 15 is pivotally supported at its rear portion (the left end of FIG. 1) so that its front portion (the right end of FIG. 1) is vertically movable.

A lever 17 is disposed at a front end of the sheet supply tray 9 to raise the front end of the sheet pressing plate 15. The lever 17 is L-shaped in a cross sectional view in such a manner as to enclose the sheet pressing plate 15 from the front to the bottom. An upper end of the lever 17 is attached to a lever shaft 18 disposed at the front end of the sheet supply tray 9. A rear end of the lever 17 contacts a lower surface of the front end of the sheet pressing plate 15. When the lever shaft 18 rotates in a clockwise direction in FIG. 1, the lever 17 pivots on the lever shaft 18 such that the rear end of the lever 17 raises the front end of the sheet pressing plate 15. When the sheet supply tray 9 is removed from the housing 2, the sheet pressing plate is configured to move downward under its own weight.

The sheet supply mechanical part 4 includes a sheet supply roller 10 disposed at the front end of and above the sheet supply tray 9, and a pickup roller 12 disposed at the rear of the sheet supply roller 10 so as to contact an uppermost recording sheet 3 placed in the sheet supply tray 9. A reverse guide 37 is disposed at a position facing a front half of a circumferential surface of the sheet supply roller 10. The reverse guide 37 includes a guide surface 16 that is configured to guide a recording sheet 3 by reversing the sheet feed direction. The recording sheet 3 passes through a space defined between the circumferential surface of the sheet supply roller 10 and the guide surface 16. A separation pad 11 is disposed in an entrance of the reverse guide 37. The separation pad 11 is configured to be pressed into contact with the sheet supply roller 10 by an urging force of a spring. In the reverse guide 37, a pinch roller 13 is disposed on a downstream side of the separation pad 11. A paper dust removing roller 8 is disposed on a downstream side of the pinch roller 13. The pinch roller 13 and the paper dust removing roller 8 face the sheet supply roller 10.

The uppermost recording sheet 3 in the sheet supply tray 9 presses against the pickup roller 12 by the sheet pressing plate 15, fed toward the entrance of the reverse guide 37 upon rotation of the pickup roller 12, caught between the sheet supply roller 10 and the separation pad 11, and singly separated from a stack of recording sheets 3. The recording sheet 3 fed from between the pickup roller 12 and the separation pad 11 is caught between the sheet supply roller 10 and the pinch roller 13. The recording sheet 3 is also caught between the sheet supply roller 10 and the paper dust removing roller 8, ejected from an exit of the reverse guide 37, and fed to register rollers 14 located on a downstream side of the sheet supply roller 10.

The register rollers 14 include a pair of rollers, which are configured to correct skew of a recording sheet 3 and feed the recording sheet 3 to an image formation position of the image forming part 5. The imaging forming part 5 is where a photosensitive drum 29 and a transfer roller 32 make contact.

The image forming part 5 includes a scanner unit 19, a process cartridge 20, and a fixing unit 21.

The scanner unit 19 is disposed in an upper portion of the housing 2. The scanner unit 19 includes a laser light source (not shown), a polygon mirror 22, an fθ lens 23, a reflecting mirror 24, a lens 25, and a reflecting mirror 26. A laser beam emitted from the laser light source based on image data is deflected at the polygon mirror 22, passes through fθ lens 23, is deflected downward at the reflecting mirror 24, and is directed to a surface of a drum body 34 of a photosensitive drum 29 in the process cartridge 20, as shown by a dot-dash line in FIG. 1.

The process cartridge 20 is disposed under the scanner unit 19. The process cartridge 20 includes, in a frame 28, a photosensitive drum 29, a scorotron charger 30, a developing cartridge 31, a transfer roller 32, and a cleaning brush 33. The frame 28 is made up of an upper frame 27A and a lower frame 27B, which are separately formed and assembled with each other.

The photosensitive drum 29 is substantially cylindrically shaped, and includes a drum body 34 and a drum shaft 35. The drum shaft 35 is supported by the upper frame 27A and the drum body 34 is rotatably supported by the drum shaft 35. The photosensitive drum 29 is rotatably provided on the drum shaft 35 in the upper frame 27A.

The scorotron charger 30 is disposed diagonally above the photosensitive drum 29 to face it. The scorotron charger 30 is configured to charge the surface of the photosensitive drum 29 evenly and positively by a corona discharge generated from a charging wire (not shown) made of tungsten.

The developing cartridge 31 is shaped in a box that is open at the rear and detachably attached to the lower frame 27B. The developing cartridge 31 includes a toner chamber 39, a supply roller 40, a developing roller 41, and a layer-thickness regulating blade 42.

The toner chamber 39 is formed as a front-side interior space of the developing cartridge 31 and is divided by a partition wall 43. The toner chamber 39 is filled with a developing agent such as nonmagnetic single component toner which is to be positively charged. A coloring agent such as carbon black and wax can be added to the toner to form toner base particles. An external additive, such as silica, also can be added to the toner to improve fluidity.

The toner chamber 39 is provided with an agitator 44. Toner in the toner chamber 39 is agitated by the agitator 44 and discharged from an opening 45 defined under the partition wall 43 toward the supply roller 40.

The supply roller 40 is disposed at the rear of the opening 45 and is rotatably supported by the developing cartridge 31. The supply roller 40 is made up of a roller made of an electrically conductive foam material and a metal roller shaft covered with the roller. The supply roller 40 is configured to rotate by an input from a motor (not shown).

The developing roller 41 is rotatably supported by the developing cartridge 31 so as to contact the supply roller 40 under compression at the rear. The developing roller 41 is configured to contact the photosensitive drum 29 when the developing cartridge 31 is attached to the lower frame 27B. The developing roller 41 is made up of a roller formed of an electrically conductive rubber material and a metal roller shaft covered with the roller. The roller shaft protrudes from both sides of the developing cartridge 31 outwardly in a width direction substantially perpendicular to the front-rear direction (in a direction passing through the sheet of FIG. 1).

The roller of the developing roller 41 can be made by covering a roller body (made of a conductive urethane rubber or silicone rubber including carbon fine particles) with a coat layer of urethane rubber or silicone rubber including fluorine. The developing roller 41 is configured to receive a bias during image developing. The developing roller 41 is configured to be driven by a motor (not shown) and rotated in the same direction as the supply roller 40.

The layer-thickness regulating blade 42 is provided with a blade body 46 made of a metal plate spring member and a pressing portion 47 having a generally semicircular shape in cross section, provided at a free end of the blade body 46, and made of insulative silicon rubber. The layer-thickness regulating blade 42 is supported by the developing cartridge 31 in an upper portion of the developing roller 41, and the pressing portion 47 presses against the developing roller 41 by an urging force of the blade body 46.

Toner discharged from the opening 45 is supplied to the developing roller 41 upon rotation of the supply roller 40, while being positively charged between the supply roller 40 and the developing roller 41 by friction. Toner supplied to the developing roller 41 goes between the pressing portion 47 of the layer-thickness regulating blade 42 and the developing roller 41 through the rotation of the developing roller 41, and is further charged therebetween. The toner is carried as a thin layer of a fixed thickness on the developing roller 41.

The transfer roller 32 is rotatably supported by the lower frame 27B, and is disposed so that, when the upper frame 27A is assembled with the lower frame 27B, the transfer roller 32 vertically contacts the photosensitive drum 29 to form a nip between the transfer roller 32 and the photosensitive drum 29. The transfer roller 32 is formed by covering a metal roller shaft with a roller made of a conductive rubber material. The transfer roller 32 is configured to be driven by a motor (not shown) and rotated in a direction opposite to the direction the photosensitive drum 29 rotates.

The cleaning brush 33 is attached to the lower frame 27B and is disposed to contact the photosensitive drum 29 behind where the upper frame 27A is assembled with the lower frame 27B.

The surface of the photosensitive drum 29 is positively and uniformly charged by the scorotron charger 30 upon the rotation of the photosensitive drum 29. The surface of the photosensitive drum 29 is exposed to the laser beam emitted from the scanner unit 19 by high speed scanning, and an electrical latent image is formed on the surface of the photosensitive drum 29 based on predetermined image data.

When toner positively charged and carried on the developing roller 41 contacts the photosensitive drum 29 upon the rotation of the developing roller 41, it is supplied to the electrical latent image formed on the surface of the photosensitive drum 29, where the potential has become low due to exposure to the laser beam. In this manner, the electrostatic latent image formed on the photosensitive drum 29 is developed with toner, a reversal takes place, and a toner image is formed on the photosensitive drum 29.

The toner image carried on the photosensitive drum 29 is transferred onto a recording sheet 3 through the application of a bias 32 while the recording sheet 3 being fed by the register rollers 14 passes through a transfer position between the photosensitive drum 29 and the transfer roller 32. The recording sheet 3 on which the toner image has been transferred is fed to the fixing unit 21. Toner remaining on the photosensitive drum 29 after transferring is collected by the developing roller 41. Foreign matter such as dust adhering to the photosensitive drum 29 after transfer is collected by the cleaning brush 33.

The fixing unit 21 is disposed at a rear of the process cartridge 20 and includes a fixing frame 48, and an ejection portion such as a heat roller 49 and a pressure roller 50. The heat roller 49 and the pressure roller 50 are disposed within the fixing frame 48.

The heat roller 49 includes a metal tube coated with fluorine resin and a halogen lamp configured to apply heat to the inside of the metal tube. The heat roller 49 is configured to be rotated by input from a motor not shown.

The pressure roller 50 is disposed facing the heat roller 49 in such a manner as to press the heat roller 49 from underneath. The pressure roller 50 is formed by covering a metal roller shaft with a roller formed of a rubber material. The pressure roller 50 is configured to rotate following the rotation of the heat roller 49.

In the fixing unit 21, toner transferred onto the recording sheet 3 at a transfer position is thermally fixed onto the recording sheet 3 while the recording sheet 3 passes through between the heat roller 49 and the pressure roller 50. The recording sheet 3 on which toner has been fixed is fed to the sheet discharge mechanism 6.

The sheet discharge mechanism 6 includes a guide portion such as a sheet discharge guide 113, and a sheet discharge roller 110 configured to eject a recording sheet to the upper output tray 100. In the laser printer 1, a recording sheet 3 on which image has been thermally fixed is fed to either one of two feed paths, a first feed path 118 and a second feed path 119. When the rear cover 116 is kept in the closed position, the recording sheet 3 being fed from between the heat roller 49 and the pressure roller 50 is guided to the upper output tray 100 via the first feed path 118. When the rear cover 116 is kept in the open position, the recording sheet 3 is guided to the rear cover 116 via the second feed path 119 as shown in FIG. 2.

The sheet discharge guide 113 is disposed on the downstream side from the heat roller 49 and the pressure roller 50. The sheet discharge guide 113 is configured to guide the recording sheet 3 on which the image has been thermally fixed to the first feed path 118 or the second feed path 119. The sheet discharge guide 113 is configured to rotate on an axis extending horizontally (in a direction passing through the sheet of FIG. 1 or 2) in association with the rotation of the rear cover 116 between the open position and the closed position. The sheet discharge guide 113 is provided with a guide surface 114 having a gradient inclined from rear to front in a position facing the heat roller 49 and the pressure roller 50.

When the rear cover 116 is in the closed position as shown in FIG. 1, the recording sheet 3 on which the image has been thermally fixed is guided to the first feed path 118 in sliding contact with the guide surface 114 of the sheet discharge guide 113. When the rear cover 116 is in the open position as shown in FIG. 2, the sheet discharge guide 113 is rotated counterclockwise in FIG. 2, and the recording sheet 3 on which the image has been thermally fixed is guided to the second feed path 119 in sliding contact with the guide surface 114 of the sheet discharge guide 113. In this way, the recording sheet 3 is selectively guided to the first feed path 118 or the second feed path 119.

Guide ribs 120 are disposed on an inner side of the rear cover 116, which faces inside of the laser printer 1 when the rear cover 116 is kept in the closed position in such a manner as to protrude at a downstream side of the sheet discharge guide 113. The guide ribs 120 are arranged in an erect manner and extend along a direction where the recording sheet 3 is ejected from between the heat roller 49 and the pressure roller 50. Each guide rib 120 is formed with an arc surface 121 having an edge substantially arcuately shaped in a side view. The recording sheet 3 guided to the first feed path 118 by the sheet discharge guide 113 is guided to the upper output tray 100 by sliding contact with the arc surface 121. The arc surface 121 is connected to the sheet discharge roller 110 at a downstream side.

The sheet discharge roller 110 is made by covering a metal roller shaft 111 with a roller made of a rubber material, and is configured to be driven by a motor (not shown) and rotated counterclockwise. An auxiliary roller 112 is disposed ahead of the sheet discharge roller 110 in the downstream direction to face the sheet discharge roller 110. The auxiliary roller 112 is rotated upon the rotation of the sheet discharge roller 110. The recording sheet 3 fed from a downstream end of the arc surface 121 is caught between the sheet discharge roller 110 and the auxiliary roller 112, and fed to the receiving surface 101 of the upper output tray 100.

As shown in FIG. 2, when the rear cover 116 is placed in the open position, the recording sheet 3 guided to the second feed path 119 by the sheet discharge guide 113 is fed from between the heat roller 49 and the pressure roller 50 to the rear cover 116.

A tray extension 122 will be described with reference to FIG. 3.

Figure 3:
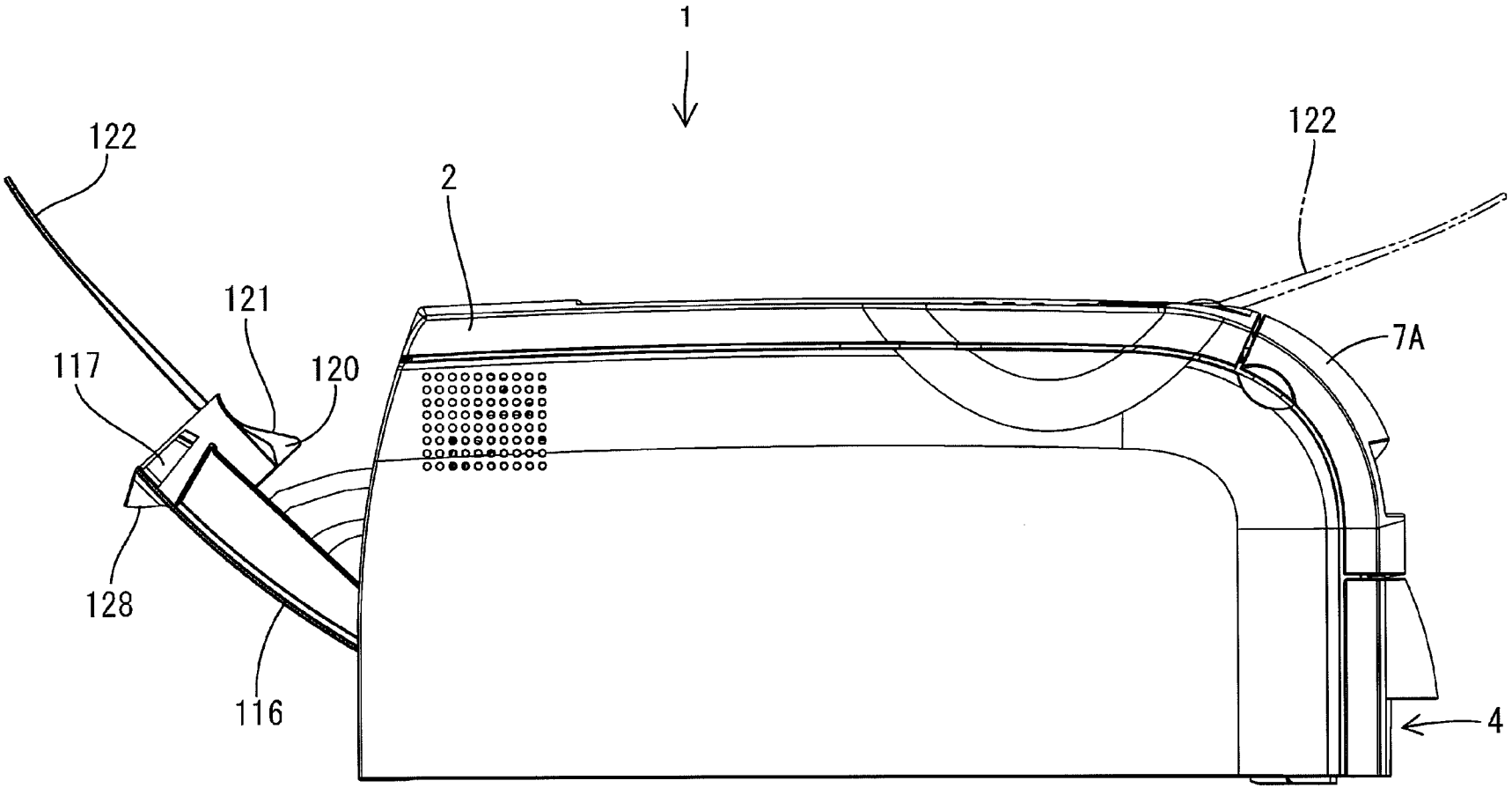
FIG. 3 is a side view of the laser printer to which a tray extension is attached according to illustrative aspects of the invention.

The tray extension 122 is attachable to the rear cover 116 as shown by a solid line in FIG. 3 and the upper output tray 100 as shown by a double dotted line in FIG. 3. The tray extension 122 is configured to receive and prevent an ejected recording sheet 3 from hanging over and slipping off the rear cover 116 or the upper output tray 100. When a recording sheet 3 is ejected to the rear cover 116 by the sheet discharge guide 113 and the guide ribs 120, the tray extension 122 is attached to an outer end of the rear cover 116 which is on a downstream side in a direction where the recording sheet 3 is ejected (hereinafter referred to as a sheet ejection direction). Alternatively, when a recording sheet 3 is ejected to the upper output tray 100 by the sheet discharge guide 113 and the guide ribs 120, the tray extension 122 is attached to an outer end of the upper output tray 100 which is on a downstream side in the sheet ejection direction.

Figure 4:
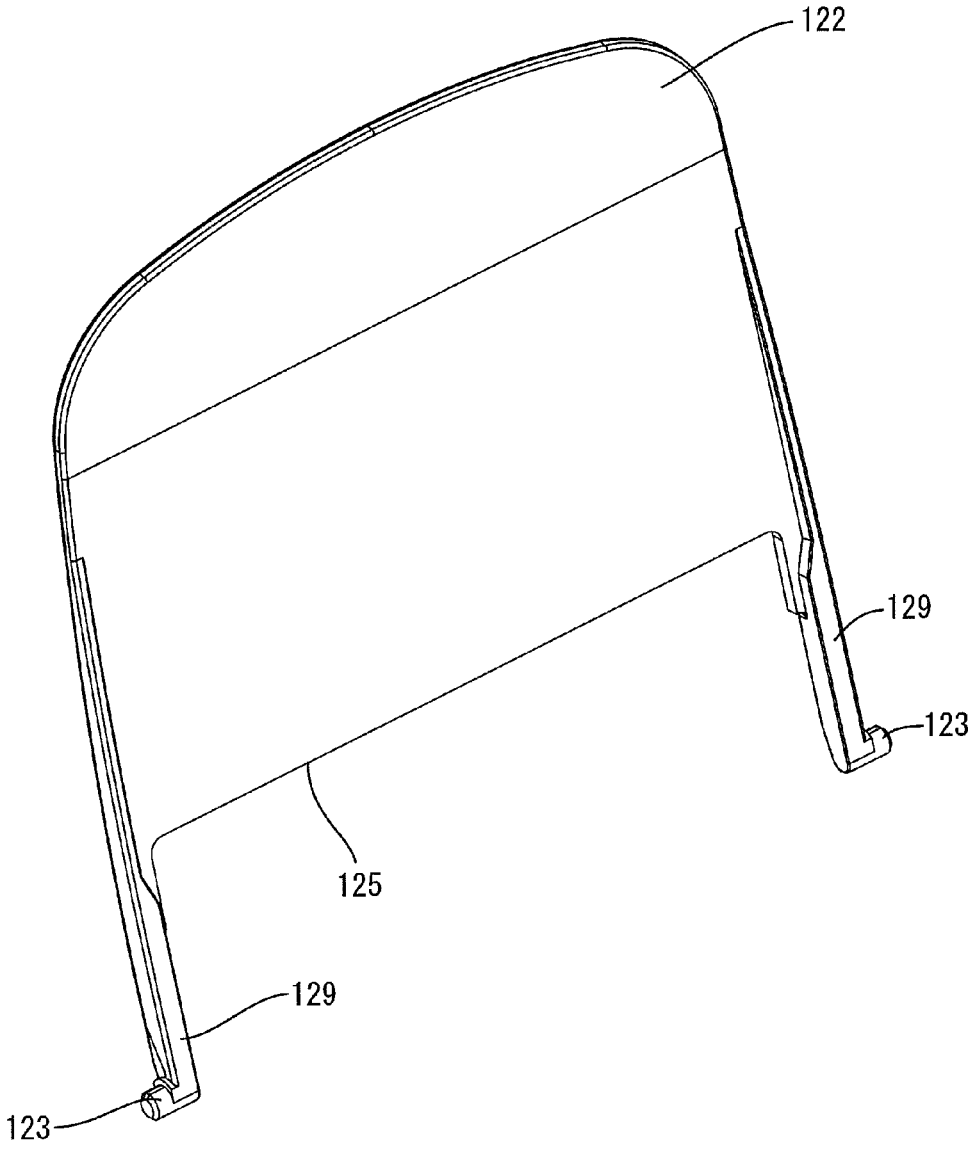
FIG. 4 is a perspective view of the tray extension according to illustrative aspects of the invention.

The tray extension 122 is made of a synthetic resin and has a plate-like structure as shown in FIG. 4, and is slightly curved on one surface. As shown in FIG. 3, the tray extension 122 is attached to the housing 2 with the curved surface facing upward. The tray extension 122 has a recessed portion 125 at its lower part in FIG. 4 to prevent collision with the guide ribs 120 of the rear cover 116. The tray extension 122 is provided with a pair of leg portions 129 at lower side edges to define the recessed portion 125 therebetween. The leg portions 129 are deformable in a width direction of the tray extension 122 (in the left-right direction in FIG. 4). The leg portions 129 have protrusions 123 protruding outwardly at outer edges of the leg portions 129. When the protrusions 123 are engaged in recessed portions 124 formed in the upper output tray 100 or through holes 130 formed in the rear cover 116, the tray extension 122 is attached to the upper output tray 100 or the rear cover 116.

Figure 5:
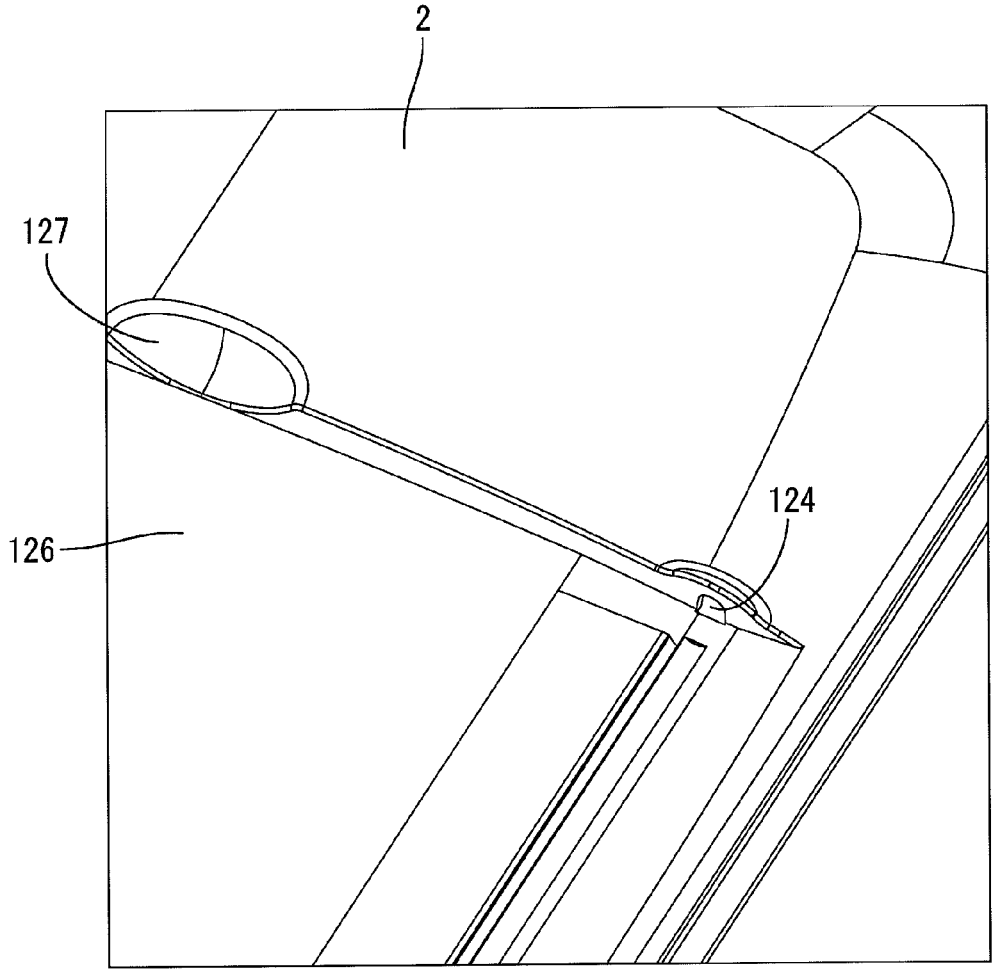
FIG. 5 is an enlarged perspective view of an upper sheet discharge tray according to illustrative aspects of the invention.
Figure 6:
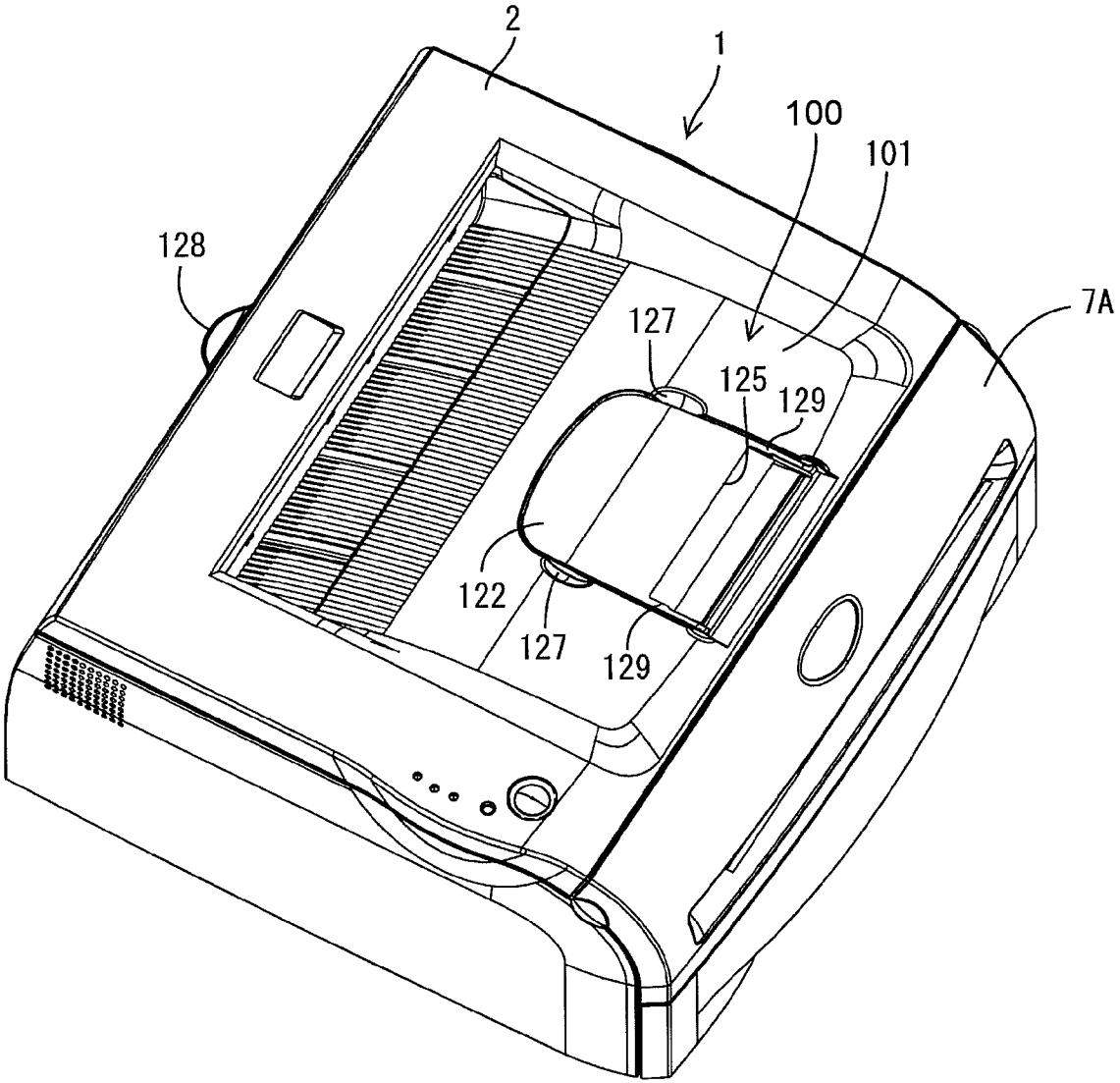
FIG. 6 is a perspective view of the laser printer in which the tray extension is stored in a storage recessed portion according to illustrative aspects of the invention.
Figure 7:
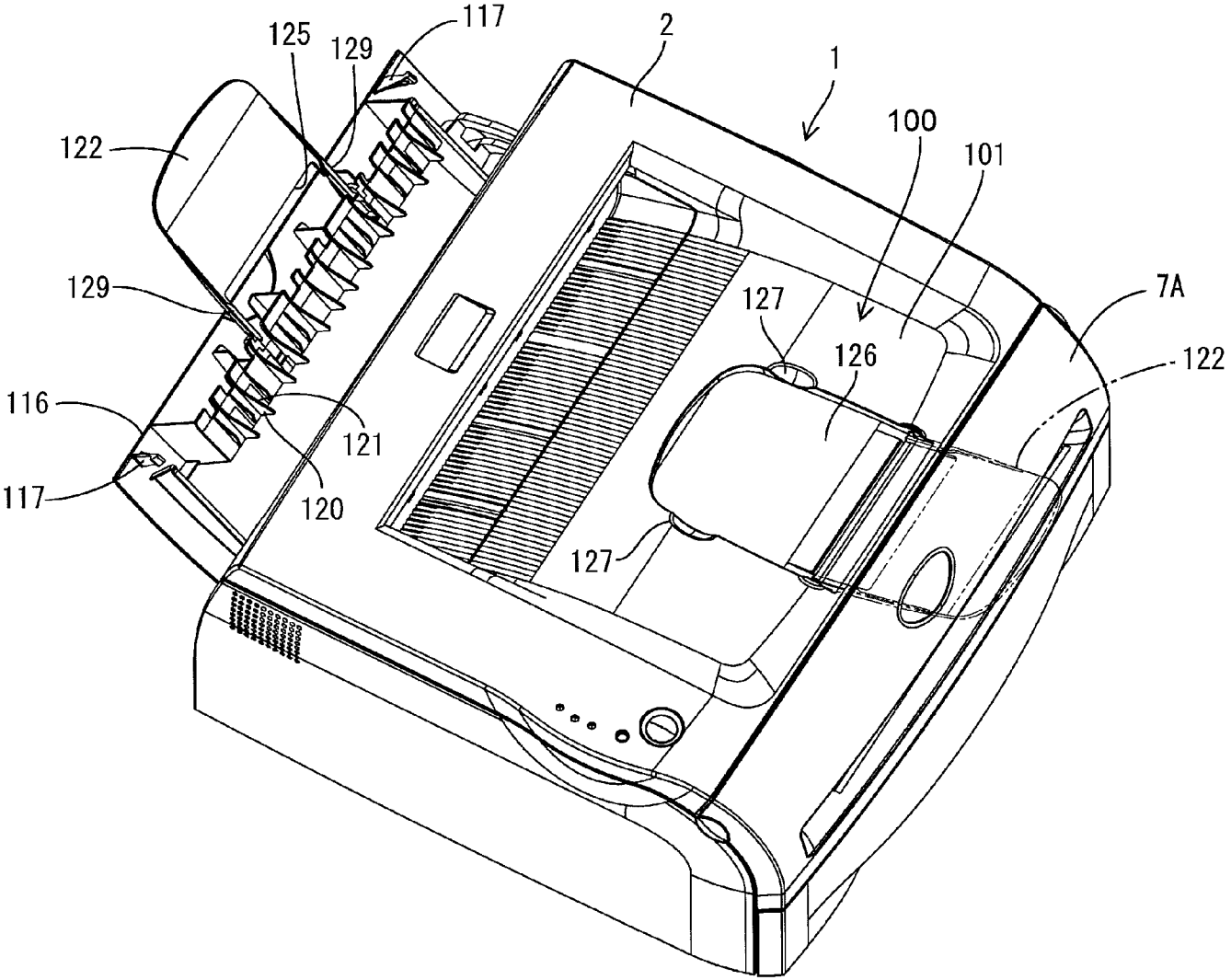
FIG. 7 is a perspective view of the laser printer in which the tray extension is attached to the rear cover according to illustrative aspects of the invention.
Figure 8:
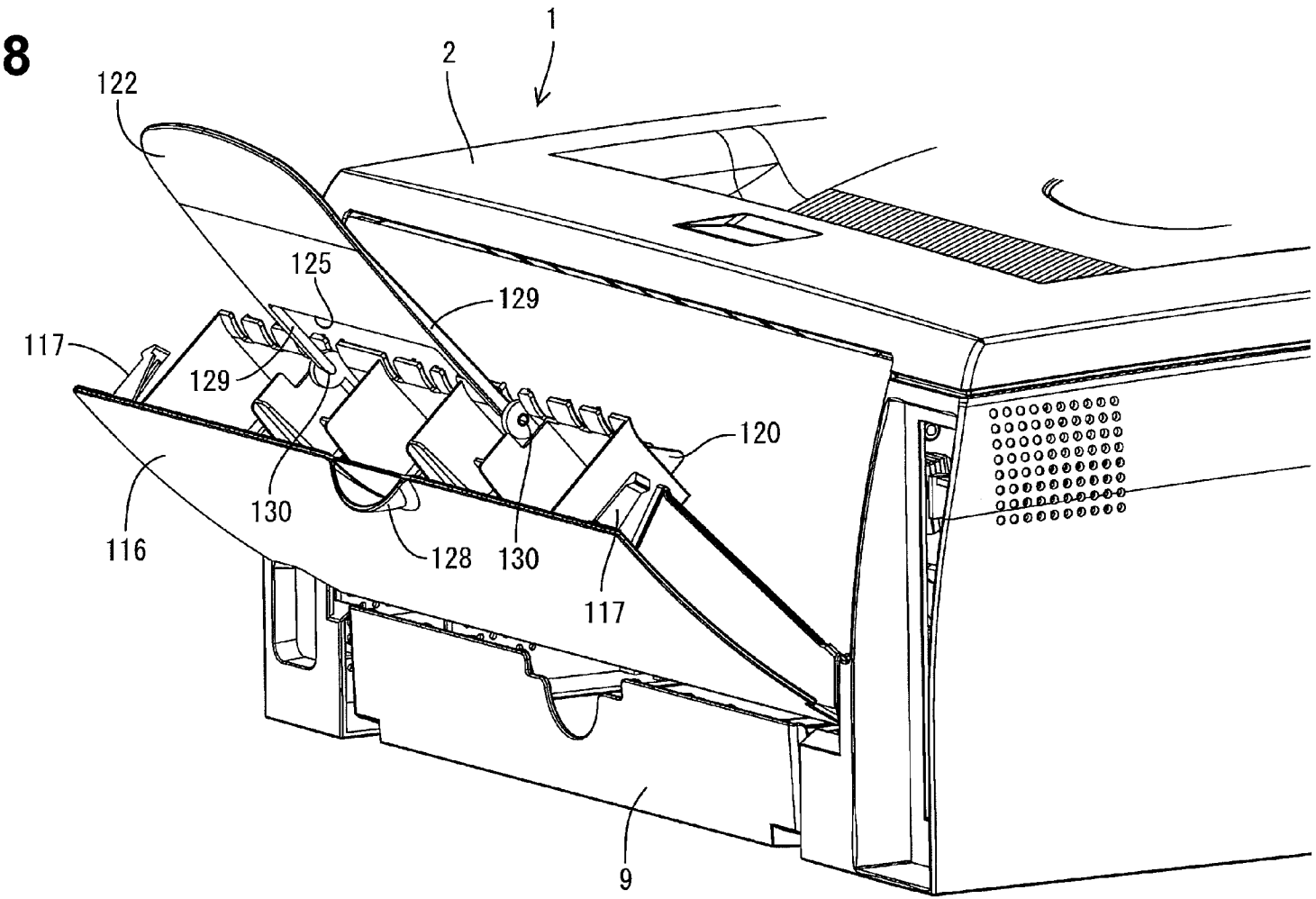
FIG. 8 is an enlarged perspective view of the laser printer in which the tray extension is attached to the rear cover according to illustrative aspects of the invention.

As shown in FIGS. 1 and 7, a tray extension storing portion 126 is recessed downwardly at the front portion of the upper output tray 100 (on the right side of FIG. 1). The tray extension storing portion 126 is configured to store the tray extension 122 therein. The recessed portions 124 are recessed on the downstream side in the sheet ejection direction on both sidewalls of the tray extension storing portion 126 as shown in FIG. 5, so as to engage the protrusions 123 of the tray extension 122. By engagement of the protrusions 123 with the recessed portions 124, the tray extension 122 is rotatably attached to the upper output tray 100. The tray extension 122 is rotatable between a storage position where the tray extension 122 is stored within the tray extension storing portion 126 as shown in FIGS. 1 and 6 and a sheet receiving position shown by a double dotted line in FIGS. 3 and 7. When the laser printer 1 is not used, the tray extension 122 can be rotated to the storage position and stored within the tray extension storing portion 126. As shown in FIGS. 5 and 6, finger recesses 127 for allowing a user to place his/her finger on the side edge of the tray extension 122 are provided at the rear side of the tray extension storing portion 126. The user places his/her finger in the finger recess 127 to raise the tray extension 122 from the storage position to the sheet receiving position.

As shown in FIGS. 3 and 7, when the tray extension 122 is attached to the upper output tray 100 and placed in the sheet receiving position, the tray extension 122 protrudes from the outer edge of the upper output tray 100 on the downstream side (right side in FIG. 3) in the sheet ejection direction.

As shown in FIG. 8, the through holes 130 to engage the protrusions 123 of the tray extension 122 are formed in the upper end portion of the rear cover 116 facing each other in the width direction of the laser printer 1. As shown in FIGS. 7 and 8, when the rear cover 116 is in the open position, the tray extension 122 is attached to the upper end portion of the rear cover 116. The tray extension 122 is attached to the rear cover 116, and the guide ribs 120 fall within the recessed portion 125 of the tray extension 122, so that the tray extension 122 is prevented from evacuating from the guide ribs 120.

As shown in FIGS. 3 and 7, when the tray extension 122 is attached to the rear cover 116, the tray extension 122 protrudes from the outer edge of the rear cover 116 on the downstream side (left side in FIG. 3) in the sheet ejection direction.

The operation and advantages of the laser printer 1 will be described for a case when the recording sheet 3 is ejected to the upper output tray 100. The rear cover 116 is rotated and kept in the closed position. After closing the rear cover 116, the sheet discharge guide 113 is rotated to a position to guide the recording sheet 3 to the first feed path 118 as shown in FIG. 1.

The tray extension 122 is attached to the upper output tray 100 by deforming the leg portions 129 inwardly in the width direction to engage the protrusions 123 of the tray extension 122 with the recessed portions 124 of the upper output tray 100. The tray extension 122 is rotated to the sheet receiving position. When the tray extension 122 is already attached to the upper output tray 100 and stored in the tray extension storing portion 126, the user places his/her finger in the finger recess 127, and raises the tray extension 122 to the sheet receiving position.

A recording sheet 3 undergoes a printing process in the image forming part 5 and is ejected from the heat roller 49 and the pressure roller 50. The recording sheet 3 is guided to the first feed path 118 in sliding contact with the guide surface 114 of the sheet discharge guide 113, and then guided to the sheet discharge roller 110 in sliding contact with the curved surface 121 of the guide rib 120. The recording sheet 3 is ejected from between the sheet discharge roller 110 and the auxiliary roller 112 toward the upper output tray 100.

The recording sheet 3 ejected to the upper output tray 100 is loaded on the upper output tray 100 and the tray extension 122. The tray extension 122 is attached to the upper output tray 100 so as to protrude from the outer edge of the downstream side in the sheet ejection direction of the upper output tray 100. Thus, even when a large-sized recording sheet 3 is used, the recording sheet 3 is received by the tray extension 122 thereby preventing the recording sheet 3 from hanging over and slipping off the upper output tray 100.

When printing is completed, the tray extension 122 is rotated from the sheet receiving position to the storage position, so that the tray extension 122 is stored in the tray extension storing portion 126 of the upper output tray 100. Thus, when the laser printer 1 is not used, the tray extension 122 can be prevented from inadvertently being detached from the laser printer 1 and getting damaged due to a careless collision with an object.

The operation and advantages of the laser printer 1 will be described for a case when the recording sheet 3 is ejected to the rear cover 116. The user places his/her finger in the finger hook portion 128, and pulls the rear cover 116 outward to rotate it from the closed position to the open position. Following the movement of the rear cover 116, the sheet discharge guide 113 is also rotated to a position to guide the recording sheet 3 to the second feed path 119 as shown in FIG. 2.

When the tray extension 122 is attached to the upper output tray 100, the tray extension 122 can be removed from the upper output tray 100 by deforming the leg portions 129 of the tray extension 122 inward in the width direction to disengage the protrusions 123 and the recessed portions 124. When the tray extension 122 is not attached to the upper output tray 100 or if another tray extension will be used, the removal procedure of the tray extension 122 can be omitted.

The leg portions 129 of the tray extension 122 are deformed inward in the width direction, and the protrusions 123 are engaged in the through holes 130 of the rear cover 116. In this manner, the tray extension 122 is attached to the rear cover 116.

The recording sheet 3 undergoes a printing process in the image forming part 5. The printed recording sheet 3 is ejected from the heat roller 49 and the pressure roller 50. The recording sheet 3 is guided to the second feed path 119 in sliding contact with the guide surface 114 of the sheet discharge guide 113, and ejected to the rear cover 116.

The recording sheet 3 ejected to the rear cover 116 is received by the rear cover 116 and the tray extension 122. The tray extension 122 is attached to the rear cover 116 so as to protrude from the outer edge of the downstream side in the sheet ejection direction of the rear cover 116. Thus, even when a large-sized recording sheet 3 is used, the recording sheet 3 can be received by the tray extension 122 thereby preventing the recording sheet 3 from hanging over and slipping off the rear cover 116.

When printing is completed, the tray extension 122 can be removed from the rear cover 116 by deforming the leg portions 129 of the tray extension 122 inwardly in the width direction and disengaging the protrusions 123 from the through holes 130. Then, the rear cover 116 can be rotated to the closed position to close the opening 115 so that the rear cover 116 is kept closed. After that, the tray extension 122 can be attached to the upper output tray 100, and rotated so that the tray extension 122 can be stored in the tray extension storing portion 126 of the upper output tray 100.

A tray extension 122 can be attached to each of the upper output tray 100 and the rear cover 116 to prevent a large-sized recording sheet from hanging over and slipping away from the upper output tray 100 or the rear cover 116. However, this increases the number of parts and leads to the increased cost.

In this illustrative embodiment, when the recording sheet 3 is ejected to the upper output tray 100, the tray extension 122 is attached to the upper output tray 100, and when the recording sheet 3 is ejected to the rear cover 116, the tray extension 122 can be attached to the rear cover 116. With this structure, when an image is formed on a large-sized recording sheet 3, the single tray extension 122 can prevent the recording sheet 3 from hanging over and slipping off the upper output tray 100 or the rear cover 116. Also, the number of parts in the laser printer 1 can be reduced. As the laser printer 1 is configured to eject a recording sheet 3 to the upper output tray 100 or the rear cover 116 selectively, it is only necessary to attach the tray extension 122 to either one of the upper output tray 100 and the rear cover 116 onto which the recording sheet 3 is ejected.

In this illustrative embodiment, when the recording sheet 3 is not ejected from a side of the laser printer 1, the rear cover 116 can be placed in the closed position to close the opening 115. As such, foreign matter such as dust and dirt can be prevented from entering the housing 2 through the opening 115 when the rear cover 116 is closed.

By placing the rear cover 116 in the closed position, the recording sheet 3 can be guided to the first feed path 118 by the sheet discharge guide 113 and the guide ribs 120, and then to the upper output tray 100.

A second illustrative embodiment of the invention will be described with reference to FIGS. 9 to 12. In FIGS. 9 to 12, a tray extension 222 is a variant of the tray extension 122 of the first embodiment, parts substantially equivalent to those described above are denoted by the same reference numerals, and descriptions therefor will be omitted.

Figure 9:
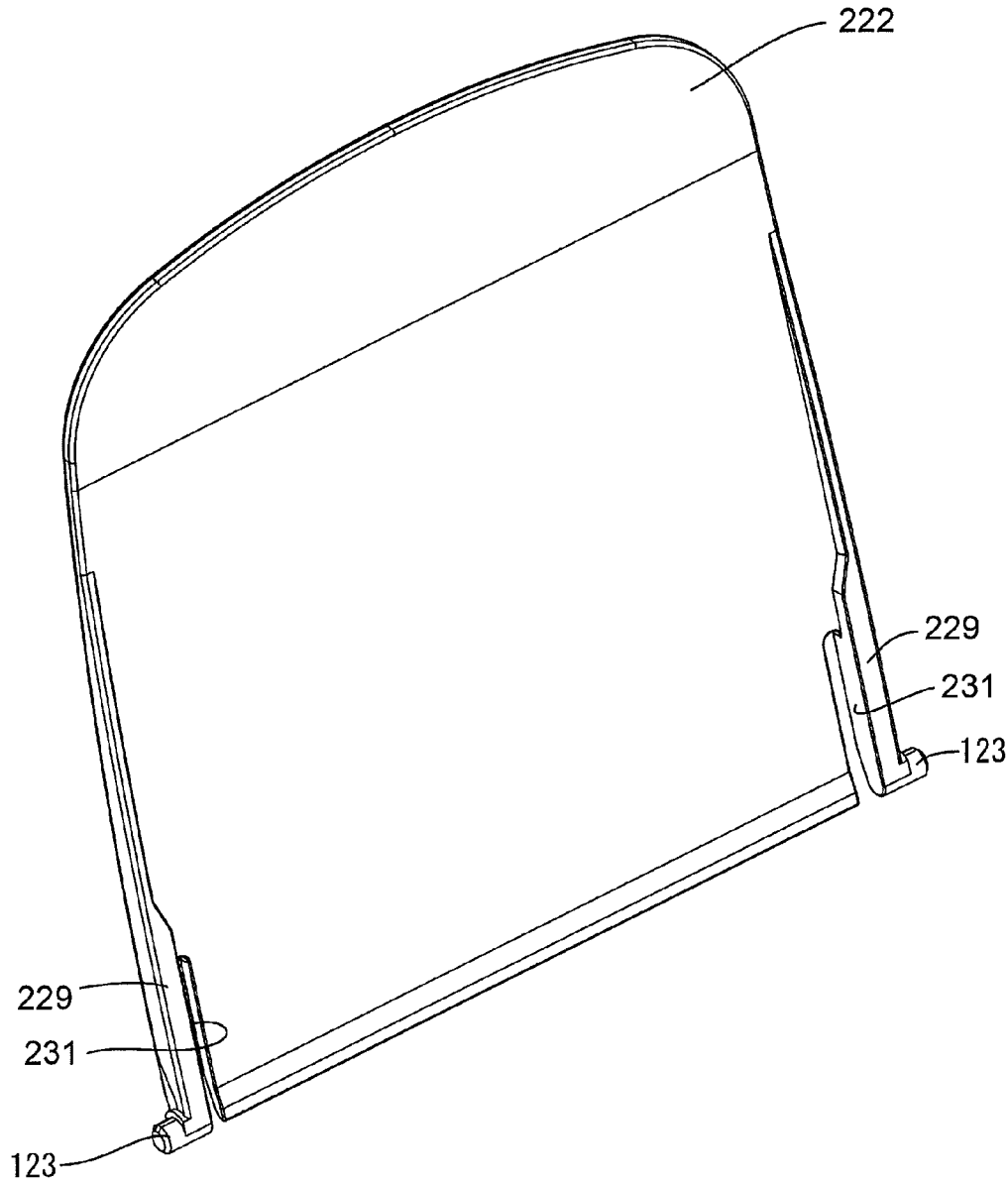
FIG. 9 is a perspective view of a tray extension of a laser printer according to a second illustrative embodiment of the invention.

As shown in FIG. 9, the tray extension 222 is provided with a pair of cutout portions 231 close to lower side edges of the tray extension 222 to define leg portions 229, which are deformable in the width direction of the tray extension 222 (in the left-right direction in FIG. 9).

Figure 10:
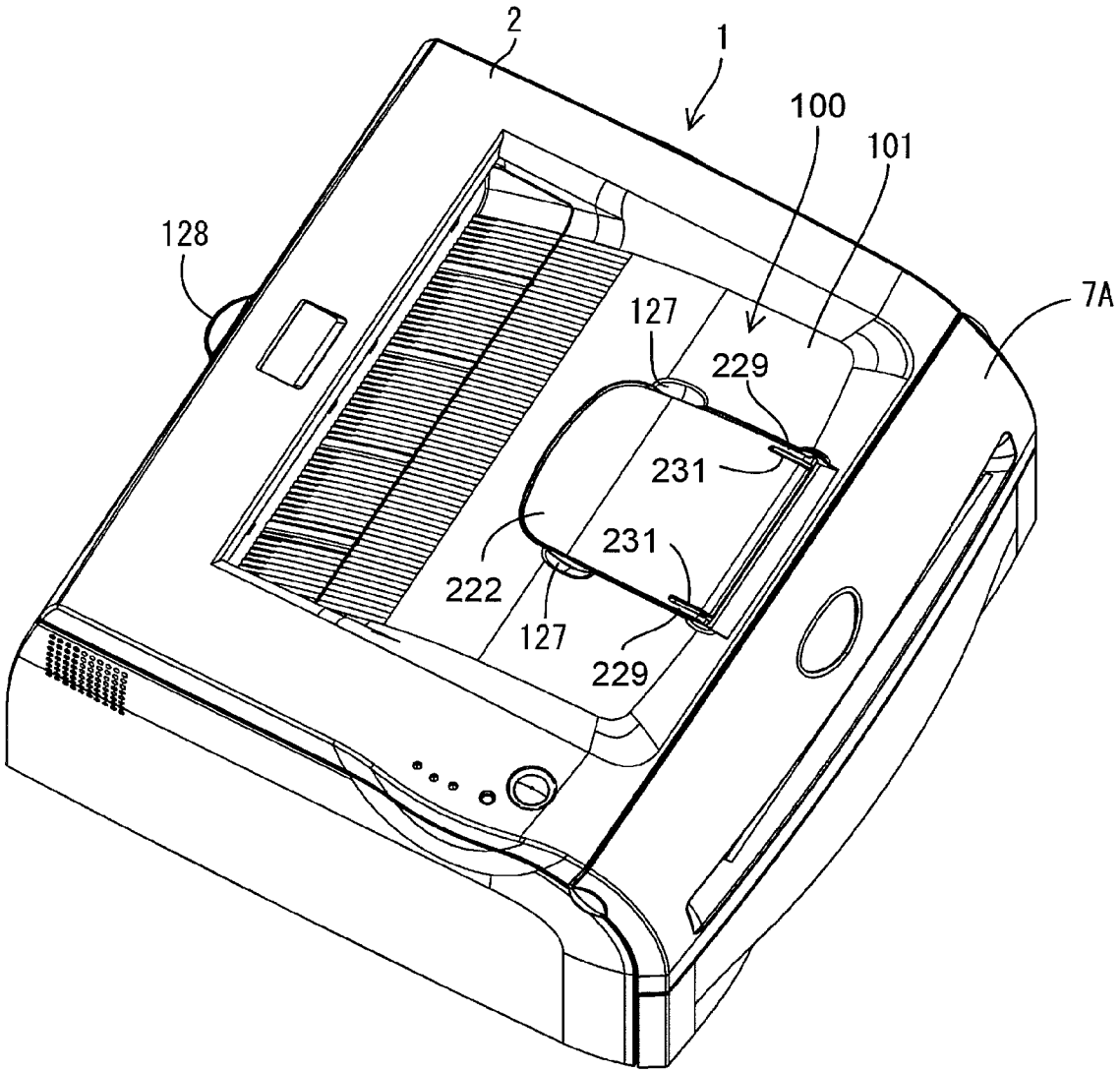
FIG. 10 is a perspective view of the laser printer in which the tray extension is stored in a storage recessed portion according to illustrative aspects of the invention.
Figure 11:
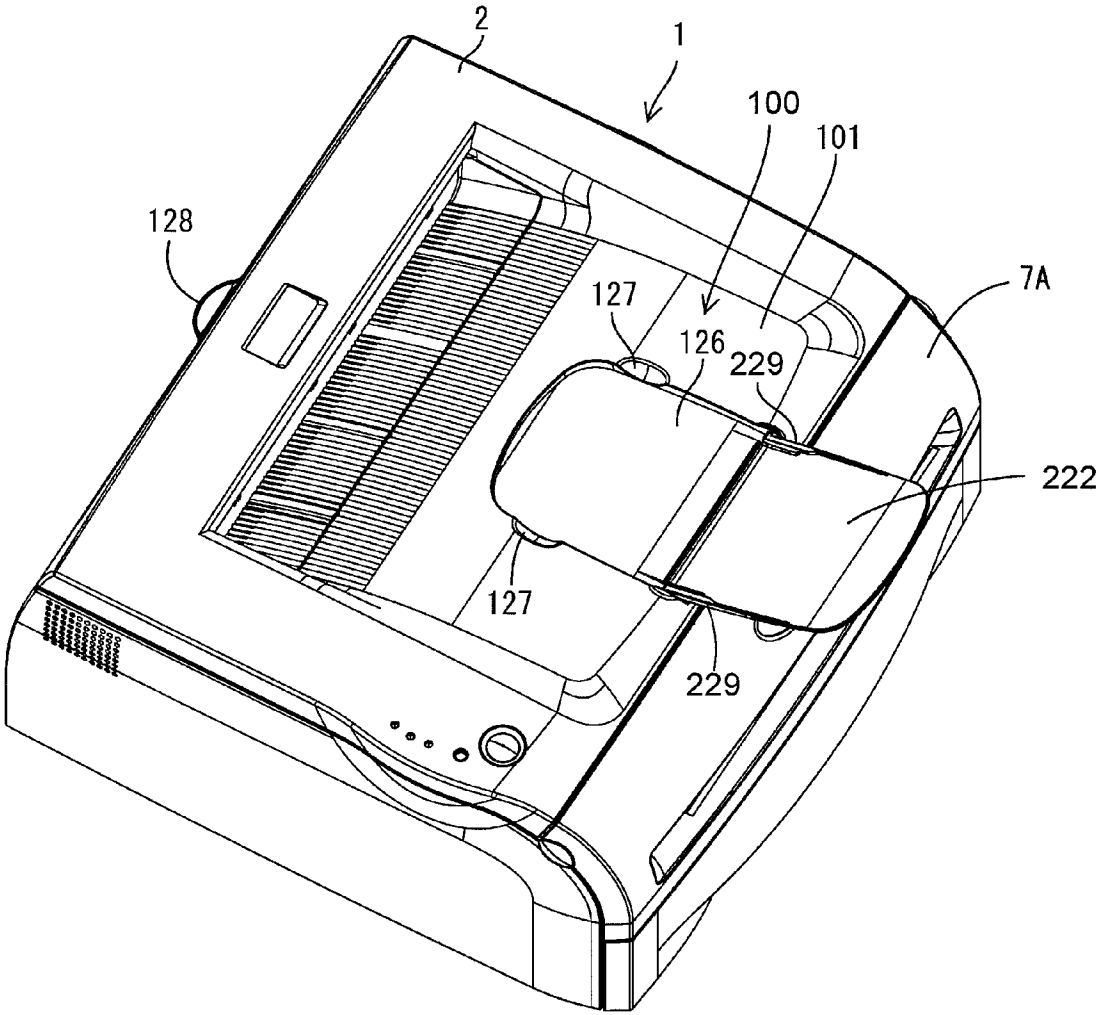
FIG. 11 is a perspective view of the laser printer in which the tray extension is placed in a sheet receiving position according to illustrative aspects of the invention.

As shown in FIGS. 10 and 11, the tray extension 222 can be attached to the upper sheet discharge tray 100 rotatably between the storage position (in FIG. 10) and the sheet receiving position (in FIG. 11).

Figure 12:
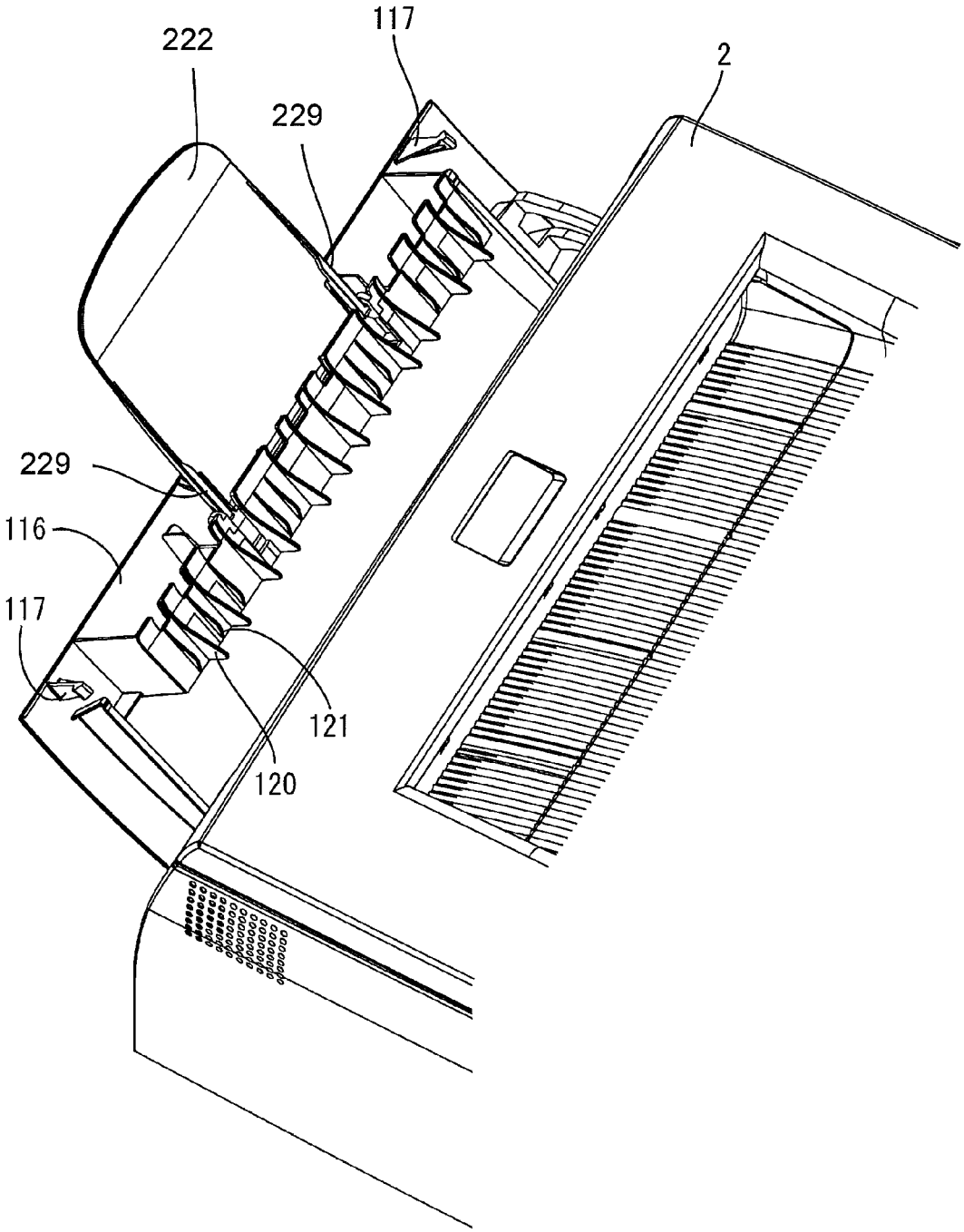
FIG. 12 is a perspective view of the laser printer in which the tray extension is attached to the rear cover according to illustrative aspects of the invention.

As shown in FIG. 12, the tray extension 222 can be attached to the upper end of the rear cover 116 in the open position. Although it is not shown, the upper end of the rear cover 116 can be formed with a clearance groove for separating a lower end of the tray extension 222 from the rear cover 116 when the tray extension 222 is attached to the rear cover 116. Thus, the recessed portion 125 can be omitted from the tray extension 222.

Figure 13:
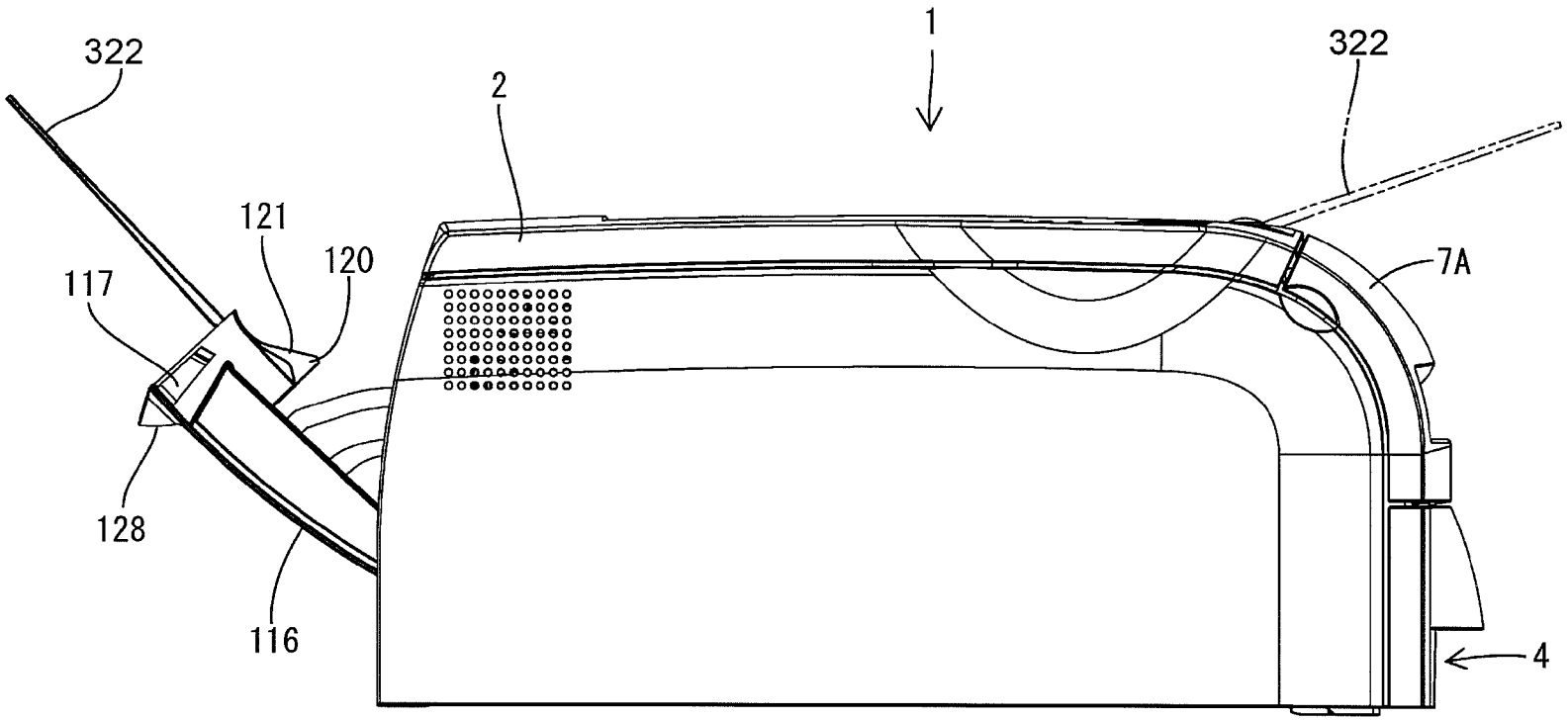
FIG. 13 is a side view of a laser printer according to a third illustrative embodiment of the invention where a tray extension is attached.

A third illustrative embodiment of the invention will be described with reference to FIG. 13. In FIG. 13, a tray extension 322 is a variant of the tray extension 122 of the first illustrative embodiment. Parts substantially equivalent to those described above are denoted by the same reference numerals, and descriptions therefor will be omitted.

The tray extension 322 is shaped like a plate so that the front side and the back side are indistinguishable, e.g. reversibly used. Thus, the tray extension 322 is attachable to the upper output tray 100 and the rear cover 116 without paying attention to the front and back sides of the tray extension 322.

According to the third illustrative embodiment, this structure can reduce workload of the user because there is no need to confirm the front side and the back side of the tray extension 322 when the user attaches the tray extension 322 to the laser printer 1.

Figure 14:
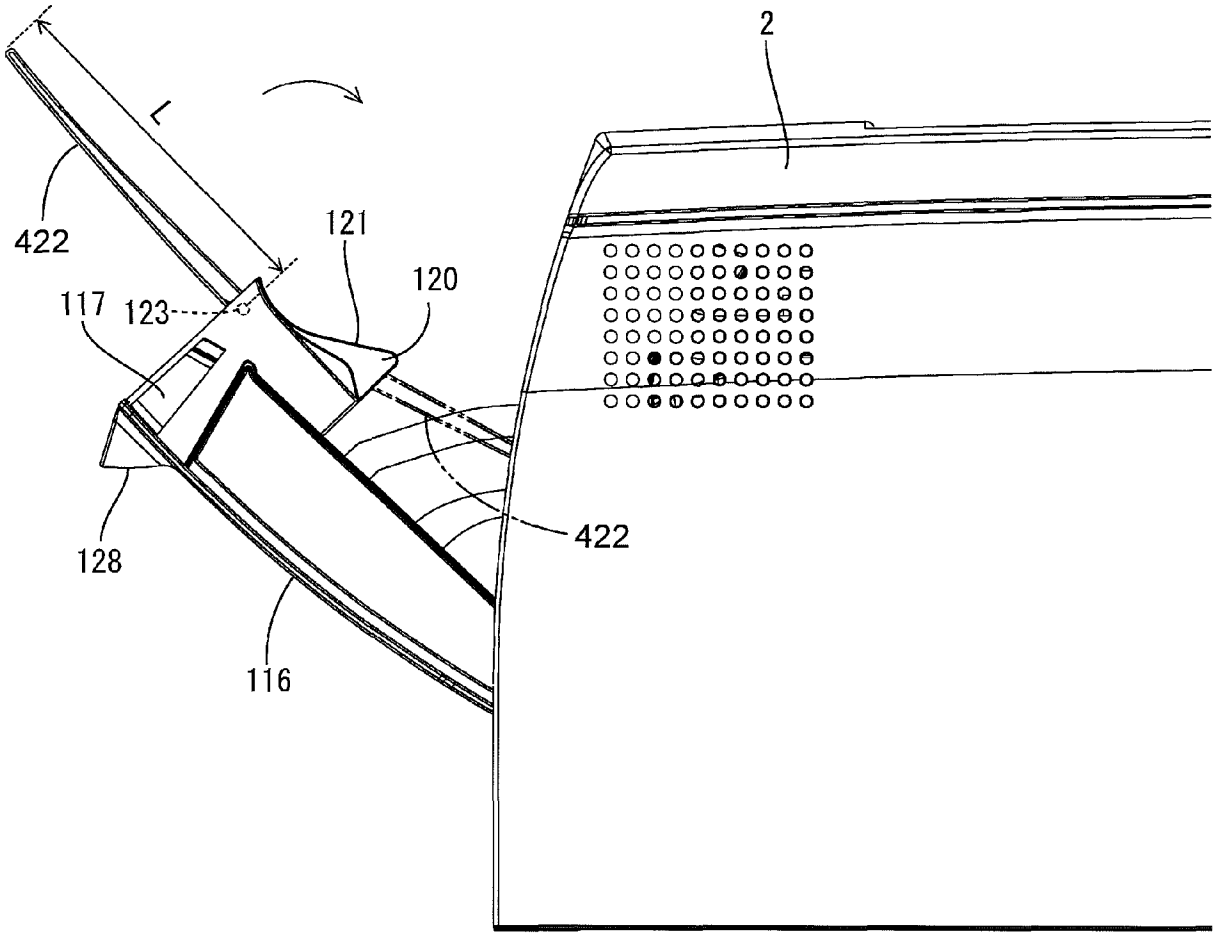
FIG. 14 is a side view of a laser printer according to a fourth illustrative embodiment of the invention where a tray extension is attached to a rear cover.

A fourth illustrative embodiment of the invention will be described with reference to FIG. 14. In FIG. 14, a tray extension 422 is a variant of the tray extension 122 of the first illustrative embodiment. Parts substantially equivalent to those described above are denoted by the same reference numerals, and descriptions therefor will be omitted.

The tray extension 422 is rotatably attached to the rear cover 116 by engaging the protrusions 123 in the through holes 130. The tray extension 422 is rotatable between a storage position shown by the double dotted line in FIG. 14 and a sheet receiving position shown by the solid line in FIG. 14. In the storage position, the tray extension 422 folds toward a side of the rear cover 116 on which the guide ribs 120 are disposed so as not to extend off the outer edge of the rear cover 116. In the sheet receiving position, the tray extension 422 extends outwardly from the outer edge of the rear cover 116 in the sheet ejection direction. The tray extension 422 is formed with the recessed portion 125 for separating the guide ribs 120 from the tray extension 422 when the tray extension 422 is in the storage position.

A dimension L of the tray extension 422 from an end where the protrusion 123 is disposed to an end opposite of the protrusion 123 is set so that, when the rear cover 116 is placed in the open position and the tray extension 422 is rotated clockwise from the sheet receiving position to the storage position as shown in FIG. 14, the tip end of the tray extension 422 is maintained out of contact with an upper end of the housing 2 defining the opening 115.

According to the fourth illustrative embodiment, after the recording sheet 3 is printed and ejected to the rear cover 116, the tray extension 422 can be rotated from the sheet receiving position to the storage position. Then, the rear cover 116 can be rotated and maintained in the closed position where the opening 115 is closed against the housing 2. Thus, when the laser printer 1 is not used, the tray extension 422 can be prevented from inadvertently being detached from the laser printer 1 and getting damaged due to a careless collision with an object.

According to the fourth illustrative embodiment, the tray extension 422 can be stored while being attached to the rear cover 116. This structure can save the user, who often directs a recording sheet 3 via the rear cover 116, from having to remove the tray extension 422 from the rear cover 116 after printing.

Although the recording sheet 3 may be assumed to be plain paper in the above illustrative embodiments, the recording sheet 3 may be another medium such as a transparency made of a synthetic resin.

In the above illustrative embodiments, the rear cover 116 also serves as a side sheet receiving portion, but is not limited to such a configuration. The rear cover 116 and the side sheet receiving portion may be formed individually, and the side sheet receiving portion may be attached to the housing 2 when a recording sheet 3 is ejected to a side of the laser printer 1.

In the above illustrative embodiments, the sheet discharge guide 113 is configured to rotate along with the rotation of the rear cover 116 to guide the recording sheet 3 to the first feed path 118 or second feed path 119. However, the sheet discharge guide 113 may be configured to not rotate along with the rotation of the rear cover 116. In other words, the user may select whether the recording sheet 3 is ejected from an upper portion of the laser printer 1 or a side portion thereof, and change the position of the sheet discharge guide 113 according to the selection.

In the above illustrative embodiments, the guide ribs 120 are disposed on the inner surface of the rear cover 116. However, the guide ribs 120 may be disposed in the housing 2 so as to face the heat roller 49 and the pressure roller 50 to guide the recording sheet 3 to the first feed path 118 by sliding contact therewith.

Although illustrative embodiments of the invention have been described in detail herein, the scope of the invention is not limited thereto. It will be appreciated by those skilled in the art that various modifications may be made without departing from the scope of the invention. Accordingly, the illustrative embodiments disclosed herein are only exemplary. It is to be understood that the scope of the invention is not to be limited thereby, but is to be determined by the claims which follow.

What is claimed is:

1. An image forming apparatus comprising:

a housing having an image forming part configured to form an image on a recording sheet and an ejection portion configured to eject the recording sheet on which an image is formed;

an upper sheet receiving portion disposed on an upper surface of the housing and configured to receive the recording sheet ejected from the ejection portion;

a side sheet receiving portion disposed on a side of the housing and configured to receive the recording sheet ejected from the ejection portion;

an extended sheet receiving portion configured to be attachable to and removable from both of the upper sheet receiving portion and the side sheet receiving portion;

a first guide part disposed facing the ejection portion and configured to guide the recording sheet ejected from the ejection portion; and a second guide part disposed on the side sheet receiving portion and having a first state and a second state, the second guide part being configured to guide the recording sheet guided by the first guide part to the upper sheet receiving portion when in the first state and to guide the recording sheet guided by the first guide part to the side sheet receiving portion when in the second state, wherein, when the second guide part is in the first state, the second guide part engages the first guide part, wherein, when the second guide part is in the second state, the second guide part is disengaged from the first guide part and disposed downstream of a most downstream end of the first guide part in a direction in which the recording sheet is ejected, wherein the upper sheet receiving portion is configured to pivotally support the extended sheet receiving portion such that the extended sheet receiving portion pivots between a first position where the extended sheet receiving portion is retracted and a second position where the extended sheet receiving portion protrudes from the upper sheet receiving portion in the direction in which the recording sheet is ejected, wherein the side sheet receiving portion is configured to pivotally support the extended sheet receiving portion such that the extended sheet receiving portion pivots between a third position where the extended sheet receiving portion protrudes from the side sheet receiving portion in the direction in which the recording sheet is ejected and a fourth position where the extended sheet receiving portion is retracted, wherein, when the second guide part is in the first state, the upper sheet receiving portion and the extended sheet receiving portion in the second position receive the recording sheet ejected from the ejection portion, and wherein, when the second guide part is in the second state, the side sheet receiving portion and the extended sheet receiving portion in the fourth position receive the recording sheet ejected from the ejection portion.

2. The image forming apparatus according to claim 1, wherein the extended sheet receiving portion is configured to be attachable to each of the upper sheet receiving portion and the side sheet receiving portion in two ways.

3. The image forming apparatus according to claim 1, wherein the side of the housing has an opening, and the side sheet receiving portion is configured to pivot on an axis extending horizontally in the side of the housing defining the opening, and the side sheet receiving portion is configured to be rotated between a closed position where the opening is closed and an open position where the opening is opened.

4. The image forming apparatus according to claim 3, wherein the ejection portion is disposed to face the opening of the housing, the second guide part includes a guide rib, the guide rib protruding, when the side sheet receiving portion is in the closed position, toward a side of the side sheet receiving portion located inside of the housing, and the guide rib being configured to guide the recording sheet by sliding contact when ejected from the ejection portion to the upper sheet receiving portion.

5. The image forming apparatus according to claim 3, wherein the extended sheet receiving portion is attached to the side sheet receiving portion when in the open position and is configured to pivot between the third position and the fourth position on an axis extending horizontally at an outer edge of the side sheet receiving portion located on a downstream side in the direction in which the recording sheet is ejected, and wherein the extended sheet receiving portion is formed with a recessed portion that separates the guide rib of the side sheet receiving portion when the extended sheet receiving portion is in the fourth position.

6. The image forming apparatus according to claim 1, wherein the ejection portion is disposed between the image forming part and the first guide part and includes a heat roller.

7. An image forming apparatus comprising:

an image forming part configured to form an image on a recording sheet;

an upper sheet receiving portion disposed above the image forming part and configured to receive the recording sheet on which the image is formed;

a first guide portion configured to guide the recording sheet conveyed from the image forming part;

a second guide portion configured to guide the recording sheet guided by the first guide portion; and an extended sheet receiving portion detachably attachable to the second guide portion, wherein the first guide portion is configured to pivot between a first position and a second position about a first pivot point, wherein the second guide portion is configured to pivot between a third position and a fourth position about a second pivot point different from the first pivot point, wherein, when the first guide portion is in the first position and the second guide portion is in the third position, the first guide portion and the second guide portion guide the recording sheet to the upper sheet receiving portion, wherein, when the first guide portion is in the second position and the second guide portion is in the fourth position, the first guide portion, the second guide portion and the extended sheet receiving portion receive the recording sheet ejected from the image forming part and the second pivot point is located downstream of the first pivot point in a sheet conveying direction, wherein the first pivot point does not move when the second guide portion pivots between the third position and the fourth position, wherein the second pivot point does not move when the first guide portion pivots between the first position and the second position, wherein the extended sheet receiving portion is configured to pivot between a fifth position and a sixth position about a third pivot point different from the first pivot point and the second pivot point when the second guide portion is in the second position, wherein, when the extended sheet receiving portion is in the fifth position, the extended sheet receiving portion extends from the second guide portion and is configured to receive the recording sheet guided by the first guide portion and the second guide portion, and wherein, when the extended sheet receiving portion is in the sixth position, the extended sheet receiving portion is configured to fold in the second guide portion in the third position.

8. The image forming apparatus according to claim 7, wherein, when the first guide portion is in the second position and the second guide portion is in the fourth position, the second guide portion is disposed downstream of a most downstream end of the first guide portion in a direction where the recording sheet is ejected.

9. The image forming apparatus according to claim 7, further comprising a third guide portion disposed stationary relative to the upper sheet receiving portion and configured to guide the recording sheet guided by the second guide portion to the upper sheet receiving portion.

10. The image forming apparatus according to claim 9, wherein the first guide portion, the second guide portion and third guide portion define a U-shaped path along which the recording sheet passes.

11. The image forming apparatus according to claim 7, further comprising a heat roller disposed downstream of the image forming part, wherein the heat roller is a most downstream roller which conveys the recording sheet when the first guide portion is in the second position and the second guide portion is in the fourth position.

12. The image forming apparatus of claim 1, wherein the first guide part is configured to pivot between a third state and a fourth state about a first pivot point and wherein the second guide part is configured to pivot between the first state and the second state about a second pivot point, wherein the second pivot point is located downstream of the first pivot point in a sheet conveying direction, wherein the first pivot point does not move when the second guide part pivots between the first and second states, wherein the second pivot point does not move when the first guide part pivots between the third and fourth states.

* * * * *